United States Patent [19]

Schmoll, III

[11] 4,308,422

[45] Dec. 29, 1981

[54] CIRCUIT FOR MODULATING A MUSICAL TONE SIGNAL TO PRODUCE A ROTATING EFFECT

[75] Inventor: George F. Schmoll, III, Mundelein, Ill.

[73] Assignee: CBS Inc., New York, N.Y.

[21] Appl. No.: 107,220

[22] Filed: Dec. 26, 1979

[51] Int. Cl.[3] ..... G10H 1/02

[52] U.S. Cl. ..... 179/1 J; 84/1.24

[58] Field of Search ..... 179/1 J, 1 GP, 1 G; 84/1.24, 1.25, DIG. 26

[56] References Cited

U.S. PATENT DOCUMENTS

| | | | |
|---|---|---|---|
| 3,719,782 | 3/1973 | Barnum | 179/1 J |
| 3,749,837 | 7/1973 | Doughty | 179/1 J |
| 4,008,641 | 2/1977 | Takada et al. | 179/1 J |

*Primary Examiner*—Bernard Konick
*Assistant Examiner*—J. A. Popek
*Attorney, Agent, or Firm*—Spencer E. Olson

[57] ABSTRACT

A device for electronically modulating a musical tone signal to produce substantially the radiation effects produced by a rotary loudspeaker with the aid of two loudspeakers, in which circuit an amplitude modulator is associated with one loudspeaker and a variable delay device is associated with the other loudspeaker, the musical tone signal being applied to both the amplitude modulator and the variable delay device, and both the variable delay device and the amplitude modulator being modulated synchronously by a sub-audio frequency modulating signal. The amplitude modulator delivers an output to its loudspeaker only during positive half cycles of the modulating signal, during which time the frequency modulated signal produced by the variable delay device is going from sharp to flat, and during the period that no amplitude modulated tone signal is produced the frequency modulated signal is going from flat to sharp, whereby when the separately reproduced modulated signals are acoustically mixed a rotating sound effect is produced.

9 Claims, 4 Drawing Figures

CIRCUIT FOR MODULATING A MUSICAL TONE SIGNAL TO PRODUCE A ROTATING EFFECT

BACKGROUND OF THE INVENTION

This invention relates to an electronic circuit for modulating a musical tone signal, and more particularly to such a circuit in which the musical tone signal is modulated to produce a rotating sound effect.

The addition of pulsato, tremelo, chorus or other low frequency modulation effects to a musical tone signal enhances the richness of the resultant sounds. Pulsato may be produced using rotary sound channels, as shown in Leslie U.S. Pat. Nos. Re. 23,323, 3,080,786 and 3,174,579 among others. While this technique for producing pulsato has enjoyed wide and long-term acceptance, many investigators have attempted to electronically simulate the desirable effect in order to eliminate the bulk and cost of the rotary speaker, and the attendant mechanical problems.

One such electronic system is known from U.S. Pat. No. 4,008,641 which has three channels each coupled to a respective loudspeaker and each having an amplitude modulator therein. The musical tone signal to be modulated is applied directly to the amplitude modulator in one of the channels and through a delay circuit to the amplitude modulator in each of the other two channels. A frequency modulator is coupled to the amplitude modulator in the first channel and to the delay circuit for frequency modulating the musical tone signals therein, and phase shifters are coupled between the frequency modulator and the respective amplitude modulators in the second and third channels for shifting the phase of the musical tone signal in the channels. The outputs of the amplitude modulators are acoustically reproduced, with the musical tone signal from the first channel being in the center of the reproduced sound and the musical tone signals from the other channels being on opposite sides of the musical tone signal from the first channel. The sound emanating from the center speaker is loudest at the transition between sharp and flat of the frequency modulated signal, and one of the side speakers is loudest when the frequency modulated signal is going from flat to sharp while the other side speaker is loudest when the FM signal is going from sharp to flat; this produces the effect or rotation, but it does not accurately simulate the acoustic effect produced by a rotary speaker. That is, when the FM modulated signal is going sharp, the signal produced by one of the side speakers is more dominant than it should be. Moreover, proper operation of the circuit is highly dependent on the relative placement of the loudspeakers, and also requires rather specific positioning of the listener with respect to the loudspeakers for him to perceive a rotating sound effect.

A device requiring only two loudspeakers for electronically simulating the radiation effects produced by a rotary speaker is known from U.S. Pat. No. 4,162,372, in which circuit the input tone signal is frequency modulated at a sub-audio rate and the frequency modulated signal and the original signal are mixed and applied to two variable gain amplifiers, the outputs of which are applied to respective loudspeakers. The gains of the amplifiers are varied in phase opposition at the aforementioned sub-audio frequency, the modulating signal being applied to the amplifiers through a low-pass filter having a crossover at about 1.0 Hz, so that the amplitude modulation is more pronounced at 0.7 Hz. than at 7 Hz. This has the effect of quite closely simulating the effect in a rotary speaker pulsato generator that amplitude modulation is less distinct in the "fast" mode than in the "slow" mode, but because the amplitude modulation occurs in both channels in synchronism, the system does not simulate the effect of a rotary speaker facing away from the listener. This deficiency of the '372 system is not found in the above-described system, which does simulate the sound that is produced by a rotary speaker when the speaker is facing the back of the cabinet.

Thus, these two known systems, while each simulating to a degree many of the characteristics of the sound produced when a rotary speaker is used to modulate a musical tone signal, fails to simulate other effects, with the consequence that neither accurately simulates the pulsato and radiation effects produced by a rotary loudspeaker. Moreover, the system described in U.S. Pat. No. 4,008,641 is relatively expensive to manufacture and, has been noted previously, requires a particular placement of the loudspeakers relative to each other, and rather specific positioning of the listener with respect to the speakers, to produce the desired results.

Another system for electronically simulating the radiation effects produced by a rotary loudspeaker is described in commonly assigned application Ser. No. 107,203 filed concurrently herewith by Robert A. Finch. The system has two loudspeakers and a musical tone signal to be modulated is applied to a variable delay device associated with one of the speakers. The frequency modulated signal produced by the variable delay device is also amplitude modulated by the same sub-audio modulating signal that controls the variable delay device, and the resulting composite signal is applied as one input to a summing amplifier coupling the signal to the other speaker. The frequency components of the frequency modulated signal above a predetermined frequency are applied as a second input of the summing amplifier and summed with the composite signal, in out-of-phase relationship, to produce an effect simulative of a rotating high frequency horn radiator.

It is the object of this invention to provide a circuit for electronically modulating a musical tone signal by which an adequate rotating sound effect can be produced with minimal cost.

BRIEF DESCRIPTION OF THE INVENTION

Briefly, this object is achieved according to the invention in that the musical tone signal is differently modulated in two signal channels each of which is adapted to be coupled to a respective loudspeaker. The tone signal is amplitude modulated in a first channel at a sub-audio frequency rate, typically at either 0.7 Hz or 7 Hz for "slow" and "fast" pulsato, respectively, the modulator being operative to produce a modulated output signal only during positive half cycles of the modulating signal, the modulation envelope of which corresponds to the positive half cycle to the modulating signal. A variable delay device, or phase shifter, is provided in the other channel, the delay of which is varied in response to the sub-audio modulating signal, for producing a frequency modulated signal for reproduction by the second loudspeaker. The modulating signals applied to the amplitude modulator and the variable delay device are so phased that during the periods that there is an output from the amplitude modulator the frequency of the frequency modulated signal is going from sharp to flat, and during the periods that there is no output from the amplitude modulator the frequency modulated signal is going from flat to sharp, whereby when the separately reproduced signals are acoustically mixed a rotating sound effect is produced.

BRIEF DESCRIPTION OF THE DRAWINGS

Other objects, features and advantages of the invention will become apparent, and its construction and operation better understood, from the following detailed description, taken in conjunction with the accompanying drawings, in which.

DESCRIPTION OF THE PREFERRED EMBODIMENT

Figure 1:
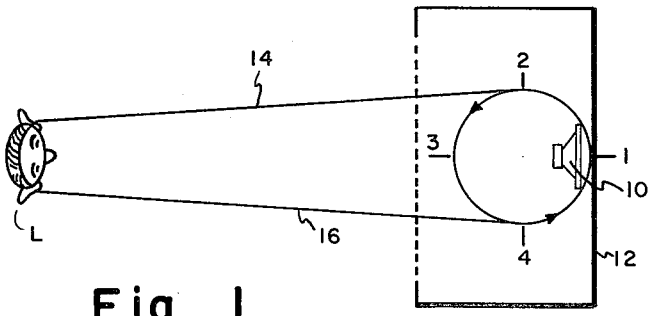
FIG. 1 is a diagrammatical representation of a rotary speaker for illustrating how the system according to this invention produces the radiation effects of a rotary speaker.

The nature of the sound effect produced by a rotary speaker, which the present invention is designed to simulate electronically, will be seen from consideration of FIG. 1, wherein a speaker 10 is mounted within a cabinet 12 for rotation about a vertical axis, in the direction indicated by the arrows. In the illustrated position of the speaker, namely, with its radiating surface directed toward the back of the cabinet, no direct sound reaches a listener L positioned in front of the cabinet; only sound reflected from the walls of the cabinet is heard by the listener. As the speaker rotates toward position 2, the source of the sound is approaching the listener and due to Doppler effect is perceived as going "sharp", and when position 2 is reached and passed, some direct sound reaches the listener along direct sound line 14.

The amplitude of the direct sound increases with continued angular displacement of the speaker, along with an increase in the perceived frequency, to a maximum amplitude when the speaker is facing the listener, namely, at position 3. Upon further rotation from position 3 toward position 4, signal reaching the listener decreases in amplitude and its frequency is perceived as going "flat", and as the speaker leaves the direct sound line 16, the amplitude of the direct signal is reduced toward zero, and the perceived frequency is still going "flat", until position 1 is again reached, at which only indirect reflected sound reaches the listener. Conventionally, a rotary speaker is rotated at one of two speeds, namely, to produce modulation at about 0.7 Hz for "slow" pulsato, or to produce 7.0 Hz modulation for "fast" pulsato.

Figure 2:
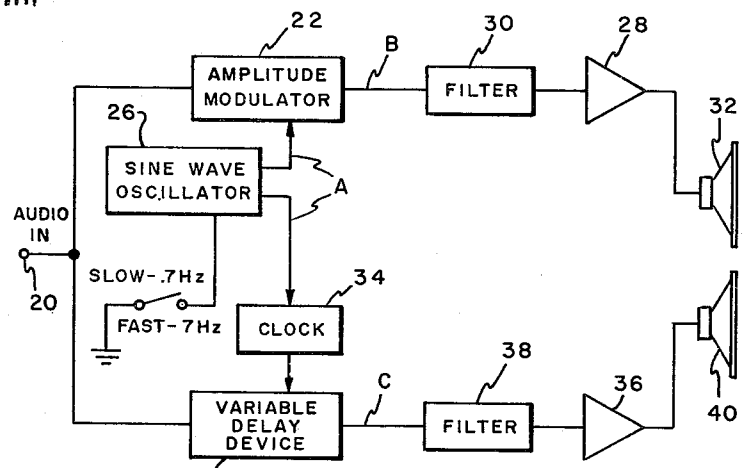
FIG. 2 is a block diagram of a system for modulating a tone signal to produce a rotating sound effect.

Referring now to FIG. 2, the circuit of the present invention receives a musical tone signal at an input terminal 20 which is applied to both of two channels, being applied directly into an amplitude modulator 22 in a first of the channels, and being applied directly to the input of a variable delay device 24 in the second channel. The musical tone signal is amplitude modulated in modulator 22 by a sinusoidal modulation wave, shown in FIG. 3A, from a modulation signal generator 26, which may be a sine wave oscillator the frequency of which is selectable to be either 0.7 Hz or 7.0 Hz for "slow" and "fast" operation, respectively. The amplitude modulator 22, which may be of the type shown in FIG. 4 (to be described), is operative to produce an amplitude modulated output signal only during positive half cycles of the modulating wave and essentially no output during negative half cycles. The amplitude modulated signal is amplified in a suitable power amplifier 28 and applied to a loudspeaker 32 for separately reproducing the signal produced in the first channel. For reasons to be described later, the signal may be filtered by a filter 30 before amplification.

The musical tone signal is modulated in the other channel by a variable delay device controlled by the modulation wave from modulation signal generator 26, which, depending upon the nature of the variable delay device, is either in phase or in phase opposition with the modulating wave applied to the amplitude modulator. In order to simulate the characteristic of a rotary speaker that the Doppler effect is more pronounced for "fast" operation than for "slow", the amplitude of the modulating wave supplied to delay device 24 preferably is larger for "fast" operation than for "slow". Variable delay device 24 may be any of several known variable phase shift devices, and may, for example, take the form of a "bucket brigade" delay line, a form of shift register, driven by a clock 34 for generating a periodic series of pulses at a given frequency, with the given clock frequency being varied by the modulating wave, thereby to produce at the output a delayed frequency modulated electrical analog representation of the input tone signal. This form of variable delay device is described in Doughty U.S. Pat. No. 3,749,837. The variable delay device causes the time phase of the input tone signal to advance or to slow down in accordance with the increase or decrease of the varying voltage of the modulating wave, and consequently there is a frequency variation in accordance with the variation of the voltage of the modulating wave per unit time. More specifically, as is shown in FIG. 3(C), as the voltage of the modulating wave is descending in value the variable delay device causes the time phase of the musical signal to slow down and cause the modulated tone signal to be "flat" with respect to the original tone signal, and during periods when the modulating wave is ascending in value, the time phase of the musical tone signal is advanced, causing the frequency modulated tone signal to be "sharp" with respect to the input audio frequency. The periods during which the frequency modulated signal is "sharp" and "flat" is indicated in the diagram above waveform (C), it being understood that the degree of "sharpness" or "flatness" is not constant throughout the respective periods but varies in accordance with the voltage of the modulation wave per unit time. The resulting frequency modulated tone signal is amplified by a suitable power amplifier 36, and reproduced in a second loudspeaker 40, and, as in the case of the other channel, may be filtered before amplification by a suitable filter 38. Since production of the effects produced by a rotary loudspeaker depends on the acoustic mixing of the described amplitude and frequency modulated tone signal, the loudspeakers 32 and 40 are positioned in close proximity to each other to effect acoustic mixing of the sound outputs therefrom; the listener perceives the acoustically mixed sounds as emanating from a single, but not a point source of sound. Satisfactory results have been obtained with a pair of 6×9 loudspeakers supported with their rims contacting each other.

Figure 3:
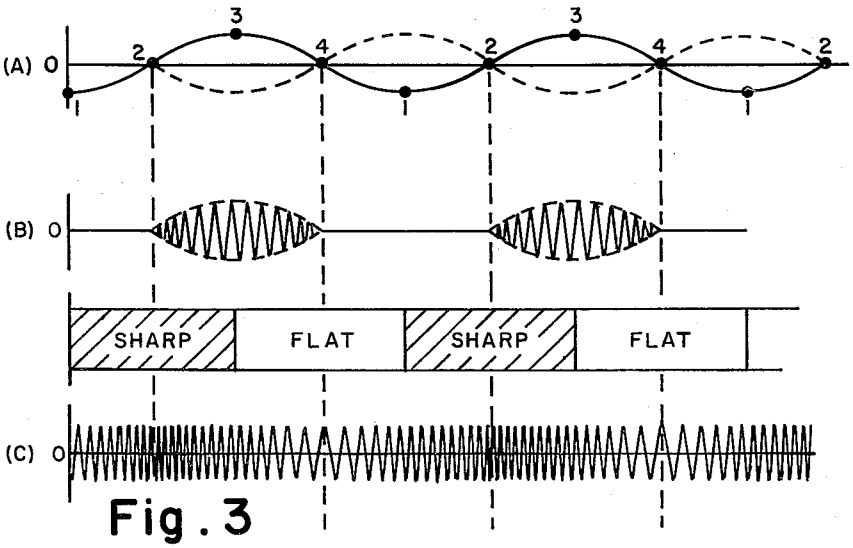
FIG. 3 are waveforms of the signals at respective points of the system of FIG. 2, which are useful for an explanation of the operation of the system.

Relating the waveforms of FIG. 3 to the diagrammatical representation of a rotary speaker, with the numerals 1, 2, 3 and 4 on the modulation waveform (A) corresponding to like numbered positions of the rotary speaker, the manner in which the present circuit simulates the radiation effects of a rotary speaker will now be described. At position 1 (when the speaker is facing the back of the cabinet) there is no output from amplitude modulator 22 (i.e., no direct sound, as is the case with a rotary speaker), and the reflected sound from a rotary speaker is simulated by the output of the second channel, in which the frequency modulated tone signal starts to go "sharp" at point 1. At point 2, corresponding to the 90° position of the rotary speaker, there begins to be an output from the amplitude modulation channel, starting at zero and increasing in amplitude as the voltage of the modulation wave increases from point 2 to point 3. Meanwhile, the output of the frequency modulation channel is still "sharp", thereby to simulate the effect of the rotary speaker rotating toward the listener in going from position 2 to position 3. At point 3 on waveform (A), corresponding to the rotary speaker facing front, the signal in the amplitude modulation channel is at maximum amplitude, and the frequency modulated signal is in transition from "sharp" to "flat", thereby simulating the effect of a rotary speaker starting to move away from the listener. At point 4 on waveform (A), corresponding to the position at which a rotary speaker is leaving the direct sound line 16 to the listener, the amplitude of the amplitude modulated signal approaches zero, and the frequency modulated signal continues to go "flat", thus simulating the effect produced by a rotary speaker when going from position 4 back to position 1. The amplitude-and frequency-modulated signals reproduced by the closely-spaced loudspeakers 32 and 40 are acoustically mixed to create the perception that the mixed signal is coming from a common source. The acoustically mixed musical tone signals have complicated modulation effects which, together with the cyclical increase and decrease in perceived amplitude and the cyclical variation in frequency from sharp to flat in the described time relationship with the changes in amplitude, simulate to a high degree the modulation effects produced by a rotary speaker. Moreover, the rotational effect is perceived by the listener throughout a wide angle of positions in front of the loudspeakers; that is, the effectiveness of the system is not significantly dependent on the position of the listener with respect to the loudspeakers.

To simulate the effect of a rotary speaker that the Doppler shift is larger in the "fast" mode than in the "slow" mode, a larger amplitude modulation wave is applied to the variable delay device when simulation of "fast" operation is desired than for "slow" operation. The amplitude of the modulating wave applied to the amplitude modulator is also large for "fast" operation, but is not necessarily the same amplitude as the modulating signal applied to the variable delay device.

Figure 4:
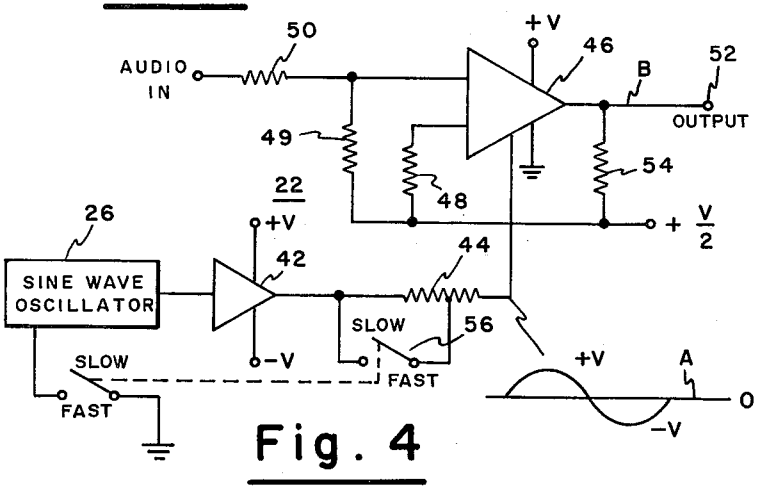
FIG. 4 is a circuit diagram of an amplitude modulator circuit suitable for use in the system of FIG. 2.

An amplitude modulator for achieving the output signal depicted in waveform (B) is obtainable with the modulator illustrated in FIG. 4, in which the sine wave signal output of oscillator 26 is amplified in an amplifier 42 operated from a split supply so as to reference its output to +v and −v, each typically having a value of 12 volts. The sine wave signal from amplifier 42 is applied through a resistor 44 as a voltage control signal to a current controlled amplifier which may, for example, be an LM3080 operational transconductance amplifier, commercially available in integrated circuit form from National Semiconductor and others. The LM 3080 is a programmable transconductance block having differential inputs and high impedance push-pull outputs. The device has high input impedance and its transconductance is directly proportional to the amplifier bias current. In the present application the device is operated from the positive side (+v) of the split supply, with half of the voltage of the positive supply applied through a resistor 48 to the minus (−) input and through a resistor 49 to the plus (+) input, to which the musical tone signal is also applied through a resistor 50. The output terminal of the device, represented by terminal 52, is connected via a resistor 54 to half supply voltage to provide operating load for the amplifier. With amplifier 42 operated from a split supply, and the LM3080 device 46 operated from a single positive supply, only the positive half cycles of the modulating sine wave, applied to the amplifier bias input of the device, affects the gain of amplifier, whereby an amplitude modulated output tone signal is produced only during positive half cycles of the modulating wave.

When the frequency of oscillator 26 is switched from a frequency of about 7 Hz ("fast" mode) to about 0.7 Hz ("slow" mode), the value of resistor 44 is increased thereby to reduce the gain of amplifier 46 to provide a modulated signal of lower amplitude for "slow" operation than for "fast". This may be accomplished by a switch 56 connected to partially shunt resistor 46 when "fast" operation is desired.

Among the several embodiments of rotatable tremulant sound producers described in the aforementioned U.S. Pat. No. Re. 23,323 are two which each use a single speaker to produce the tremulant effect. In the arrangement shown in FIG. 14 a stationary speaker delivers sound to a rotating directional horn which, because of the bend of the horn, causes some attenuation of high frequencies contained in the sound delivered by the speaker to the horn. In the embodiment shown in FIG. 21 a speaker is enclosed in a casing filled with sound absorbent material to prevent sound radiation from the back of the speaker, a directional horn is mounted on the front of the casing for cooperation with the speaker, and the whole assembly is supported to be driven in rotation about a vertical axis. In this case, the shape of the horn is such that there is little or no attenuation of high frequencies. The present invention affords the option of simulating either one or the other of these electro-mechanical systems. Should simulation of the stationary speaker-rotating horn arrangement be desired, filters 30 and 38 are provided in their respective channels to attenuate high frequencies contained in the amplitude-and frequency-modulated signals, respectively. The filters are low pass filters, typically having a gradual rolloff at about 2000 Hz. On the other hand, if it is desired to simulate the rotating speaker/horn arrangement, filters 30 and 38 are omitted.

From the foregoing description it is seen that the present invention produces a modulation effect highly simulative of that produced by a rotary speaker, and which is relatively inexpensive to manufacture from commercially available components, and is therefore much more useful for an electronic musical instrument than conventional systems or previously devised electronic systems for producing such effects.

I claim:

1. A circuit for electronically modulating a musical tone signal which modulated signal when converted to sound by two loudspeakers positioned sufficiently proximate each other to acoustically mix the sound therefrom produces an effect which simulates the radiation of sound by a rotary loudspeaker, said circuit comprising:

means for generating a sub-audio frequency, substantially sinusoidal, modulating signal;

a first signal channel coupled to a first of said loudspeakers and having therein an amplitude modulator connected to receive said tone signal and operative in response to said modulating signal to produce an amplitude modulated musical tone output signal only during positive half-cycles of said modulating signal; and a second signal channel connected to receive said tone signal and coupled to the second of said loudspeakers and having therein a frequency modulator responsive to said modulating signal to modulate the frequency of said tone signal;

said amplitude modulator and said frequency modulator respectively modulating the musical tone signal in said first and second channels such that the amplitude of the amplitude modulated tone output signal in the first channel is maximum when the frequency modulated tone output signal from the second channel is in transition from sharp to flat relative to the musical tone signal and is minimum when the frequency modulated signal in said second channel is in transition from flat to sharp, whereby to produce when the separately reproduced signals from said first and second channels are acoustically mixed an effect which simulates the radiation of sound by a rotary speaker.

2. A circuit according to claim 1, wherein the frequency of said modulating signal is selectable to be either about 0.7 Hz. or about 7.0 Hz.

3. A circuit according to claim 2, wherein said circuit further comprises means for causing the amplitude of the modulating signal applied to said frequency modulator to be larger when its frequency is about 7.0 Hz. than when its frequency is about 0.7 Hz.

4. A circuit according to claim 1, 2 or 3, wherein said frequency modulator is in the form of a bucket-brigade shift register and a clock connected to said shift register for generating a periodic series of pulses at a given frequency, and wherein said modulating signal is applied to said clock for varying said given frequency of said clock.

5. Apparatus for electronically modulating a musical tone signal to produce an effect which simulates the radiation of sound by a rotary loudspeaker, comprising:

means for generating a sub-audio frequency, substantially sinusoidal, modulating signal;

a single frequency modulator responsive to said modulating signal to modulate the frequency of said musical tone signal;

means connected to the output of said frequency modulator for applying the tone signal modulated substantially only in frequency to a first stationary transducer for converting said frequency modulated signal into sound;

a single amplitude modulator responsive to said modulating signal to modulate the amplitude of said musical tone signal, said amplitude modulator producing an amplitude-modulated tone signal only during positive half-cycles of said modulating signal; and means connected to the output of the amplitude modulator for applying the tone signal modulated substantially only in amplitude to a second stationary transducer for converting said amplitude-modulated signal into sound;

the phase relationship of the modulating signal applied to said frequency modulator and to said amplitude modulator being such that the amplitude-modulated signal has maximum amplitude when the frequency modulated signal is in transition from sharp to flat relative to the musical tone signal and has substantially zero amplitude when the frequency modulated signal is in transition from flat to sharp;

said first and second transducers being positioned sufficiently proximate each other that the sounds separately produced by thereby are acoustically mixed.

6. Apparatus for electronically modulating a musical tone signal which modulated signal when converted to sound produces an effect which simulates the radiation of sound by a rotary loudspeaker, said apparatus comprising:

means for generating a sub-audio frequency, substantially sinusoidal, modulating signal;

a first signal channel having therein an amplitude modulator connected to receive said musical tone signal and operative in response to said modulating signal to produce an amplitude modulated output signal only during positive half-cycles of said modulating signal, and including first transducer means for converting the amplitude modulated tone signal into sound;

a second signal channel having therein a frequency modulator connected to receive said musical tone signal and responsive to said modulating signal to modulate the frequency of the musical tone signal and produce a frequency modulated output signal which goes from sharp to flat relative to the musical tone signal during periods that an amplitude modulated tone signal is produced in the first channel, and which goes from flat to sharp during periods that no amplitude modulated tone signal is produced in the first channel, and including second transducer means for converting the frequency modulated tone signal into sound;

said first and second transducer means being positioned sufficiently proximate each other that the sound therefrom is acoustically mixed, the acoustically mixed sound from the two channels producing radiation effects simulative of that produced by a rotary speaker.

7. Apparatus according to claim 5 or 6, wherein the frequency modulator is in the form of a bucket-brigade shift register and a clock connected to the shift register for generating a periodic series of pulses at a given frequency, and wherein the modulating signal is applied to the clock for varying the given frequency of the clock.

8. Apparatus according to claim 5 or 6, wherein the frequency of said modulating signal is selectable to be either about 0.7 Hz or about 7.0 Hz for simulating "slow" and "fast" operation, respectively, of a rotary speaker.

9. Apparatus according to claim 8, wherein said apparatus further comprises means for causing the degree of frequency modulation in the frequency modulator is larger when the frequency of the modulating signal is about 7.0 Hz than when its frequency is about 0.7 Hz.

* * * * *